US005463958A

United States Patent [19]

Roheim

[11] Patent Number: 5,463,958

[45] Date of Patent: Nov. 7, 1995

[54] MORTAR ADAPTOR

[76] Inventor: Karl-Axel Roheim, Skolgatan 2, Nynäshamm, Sweden, 5-149 30

[21] Appl. No.: 295,634

[22] PCT Filed: Feb. 24, 1993

[86] PCT No.: PCT/SE93/00155

§ 371 Date: Aug. 25, 1994

§ 102(e) Date: Aug. 25, 1994

[87] PCT Pub. No.: WO93/17294

PCT Pub. Date: Sep. 2, 1993

[51] Int. Cl.[6] ..... F42B 8/00; F42B 30/10

[52] U.S. Cl. ..... 102/445; 102/395; 42/77

[58] Field of Search ..... 102/372, 373, 102/395, 444, 445, 446, 498, 529; 42/77

[56] References Cited

U.S. PATENT DOCUMENTS

| | | | |
|---|---|---|---|
| 2,821,923 | 2/1958 | Alderson | 102/445 |
| 3,276,374 | 10/1966 | Stadler et al. | 102/445 |
| 3,948,179 | 4/1976 | Gawlick et al. | 102/445 |

FOREIGN PATENT DOCUMENTS

| | | | |
|---|---|---|---|
| 73985 | 11/1944 | Czechoslovakia | 102/446 |
| 3204823 | 8/1983 | Germany | 42/77 |

*Primary Examiner*—Harold J. Tudor
*Attorney, Agent, or Firm*—Jacobson, Price, Holman & Stern

[57] ABSTRACT

A Mortar adapter intended to be received in the barrel of a mortar. The adapter includes a projectile firing tube and a breech region (2), wherein the projectile firing tube is intended to accommodate a practice projectile of smaller caliber than the caliber of the mortar barrel. The projectile is brought to a firing and locked state automatically as the projectile is inserted into the mortar adapter. There is provided a safety facility, which includes a breech block (7, 9) which is intended to be inserted into the adapter through the agency of a guide means (4, 5) which extends transversely to the longitudinal axis of the cylindrical breech (2) and when fully inserted forms the bottom of the breech. The measurements of the breech block in the insertion direction are such that at least one end (13, 14) of the breech block will touch the mantle line of the adapter (1) in the inserted position while the other end will lie within the adapter, so as to enable the adapter to be inserted freely in the mortar barrel (16) when the breech block (7, 9) is fully inserted. The breech block has a firing pin (15) which is so positioned that when the breech block (7, 9) is inserted, the firing pin (15) will lie centrally in register with the firing pin (22) of the mortar, so that the mortar firing pin is able to strike the firing pin (15), which in turn strikes the detonator of the practice projectile of smaller caliber inserted in the adapter.

5 Claims, 3 Drawing Sheets

MORTAR ADAPTOR

The present invention relates to a mortar adapter which has the form of a dummy mortar shell or projectile and which is intended to fit the barrel of a standard mortar. The adapter has a practice missile launching tube and a practice missile breech position and can be loaded with a practice projectile whose caliber is smaller than the caliber of the mortar barrel. The object of the present invention is to provide a mortar adapter which can be used in mortar practice and which will accommodate a practice projectile in a manner such that as the practice projectile is inserted in the mortar adapter, a safety device will be brought automatically from an active safe state to a released and locked state when the adapter is inserted into the mortar barrel.

The object is achieved in that the safety function operates automatically and has the characteristics features set forth in the characterizing clause of the following Claims.

The invention will now be described in more detail with reference to an exemplifying embodiment thereof and also with reference to the accompanying drawings, in which FIG. 1 is a longitudinal sectional view of the mortar adapter, adapter, and illustrates the locations of a practice projectile and a safety mechanism device in the form of an end closure piece, not shown in the FIG.;

Figure 6:
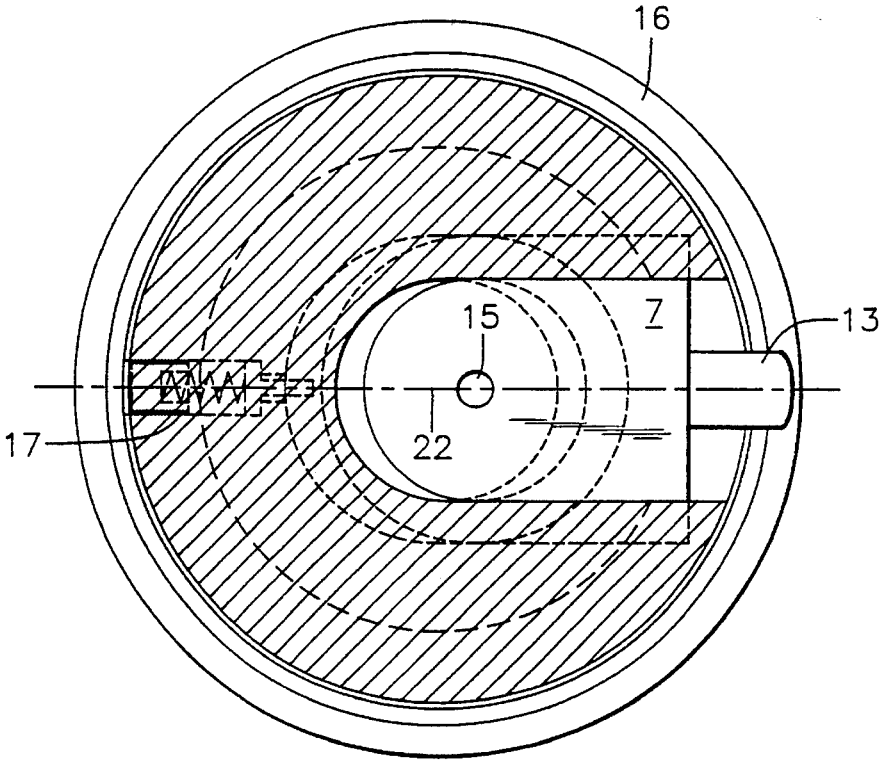
Figure 7:
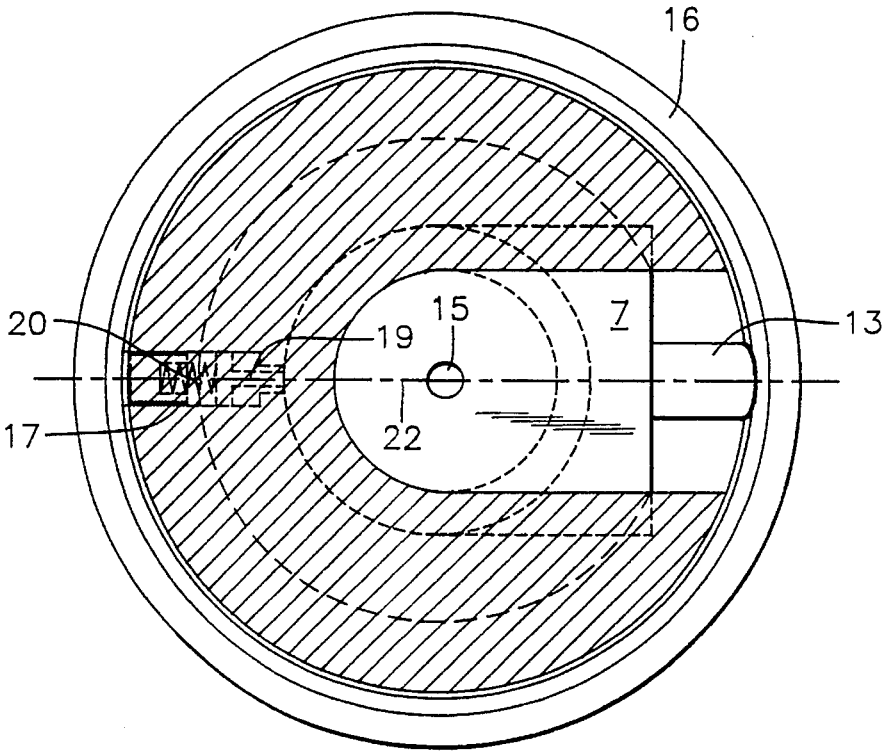

FIG. 6 illustrates the mortar adapter partially inserted into the mortar barrel and the end-closure piece inserted in a weapon-safe position in the mortar adapter; and FIG. 7 is a contemplated cross-sectional view illustrating the mortar adapter inserted to its bottom position in the barrel, wherein the Figure shows the end-closure piece fully inserted into the mortar adapter and locked in this position, although in a safety-release position for firing of the practice projectile.

Figure 1:
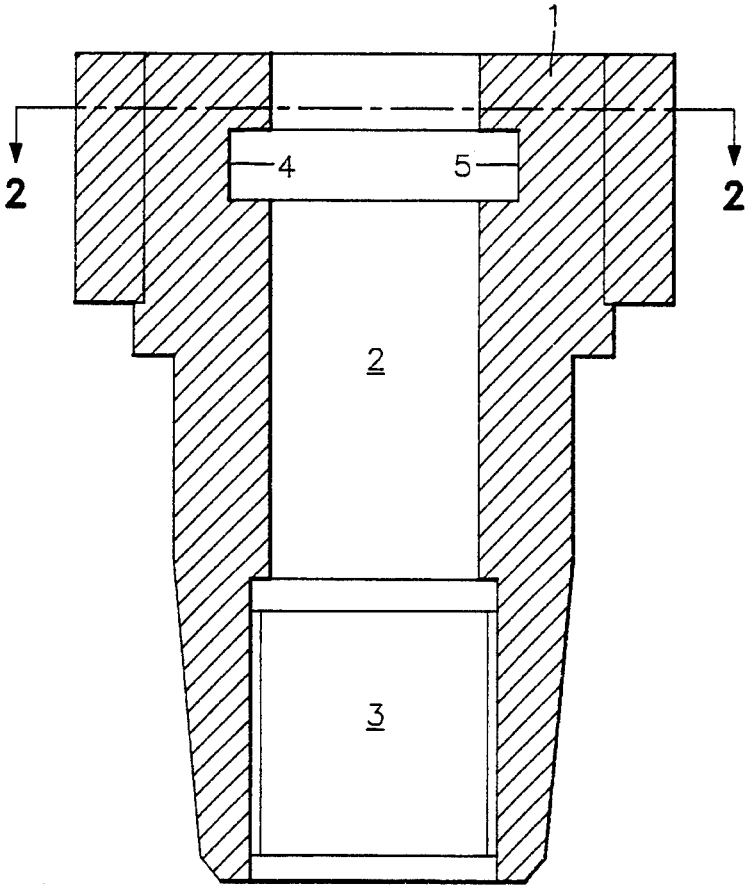

FIG. 1 is thus a longitudinal sectional view of the mortar adapter, the largest dimension of which corresponds to the caliber of the mortar barrel. The rear end of the mortar adapter is the upper end of the illustrated adapter in FIG. 1, and it is thus this end of the adapter that is inserted to the bottom position in the mortar. The mortar adapter has a centre bore 2 which forms the projectile breech position, i.e. the position of the practice projectile when located in its firing position in the mortar. The bottom end of the illustrated mortar adapter, i.e. the end which faces upwards in the mortar barrel, is provided with an attachment region 3 for accommodating the launching tube which serves as a practice projectile aiming or sighting tube. When firing a practice projectile with the aid of the mortar adapter, the adapter is first loaded with the practice projectile, placing the projectile in its breech position. The bottom of the breech is formed by an end-closure piece, hereinafter called the breech block, (not shown in FIG. 1), which is inserted into grooves 4 and 5 which extend transversely to the longitudinal axis of the breech and from one side of the mortar and beyond the other side of the breech, without passing through the other side of the mortar adapter.

Figure 2:
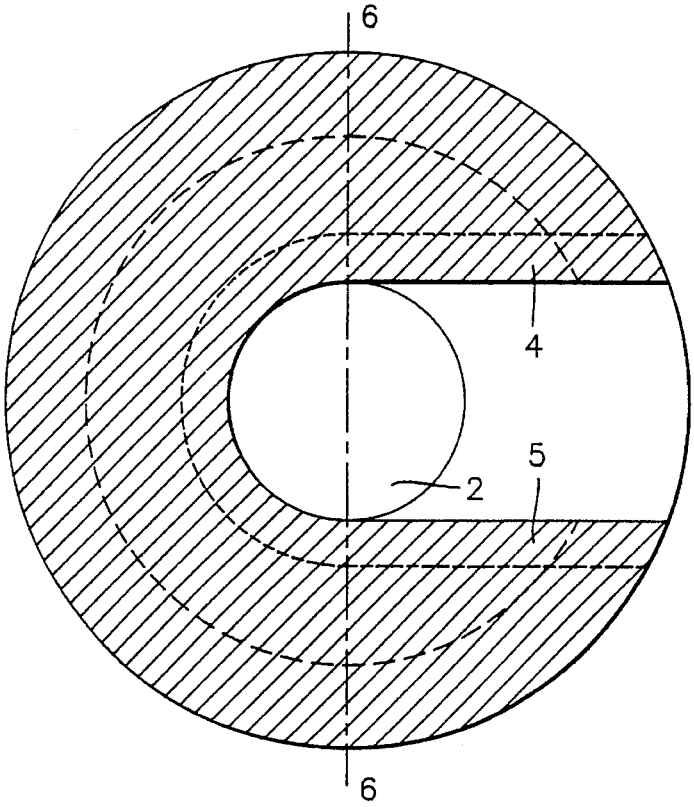
FIG. 2 is a cross-sectional view of the mortar adapter taken along the line II—II in FIG. 1 and rotated through 90°.

FIG. 2 is a cross-sectional view taken on the line II—II in FIG. 1 and illustrates the cylindrical bore 2 of the breech.

Figure 3:
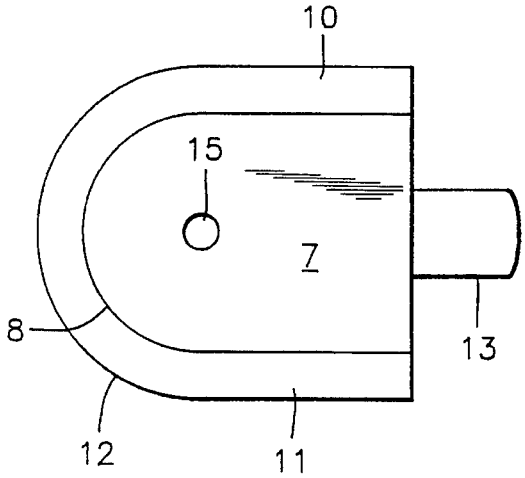
FIG. 3 is a top view of the end-closure piece.
Figure 4:
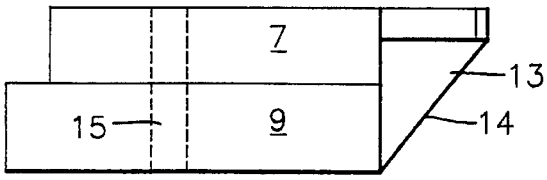
FIG. 4 is a side view of the end-closure piece.

The grooves 4 and 5 are shown to extend from the right side of the mortar adapter as shown in FIG. 2, and to extend beyond the left side of the breach region. As will be seen from the Figure, the grooves have a semi-circular configuration after passing the symmetry line 6—6. A breech block is now inserted into the grooves 4 and 5, from the right side of the FIG. 2 illustration. The breech block is shown in top view in FIG. 3 and in side view in FIG. 4. The breech block has two tiers or levels. A first tier 7 has a width which corresponds to the diameter of the breech 2. As will be seen from FIG. 3, the left end of the breech block tier 7 is semi-circular in shape, as shown at 8. The other end of the tier 7 is straight. The other tier, or level, 9 is broader than the tier 7 and has edge regions 10 and 11 which fit into respective grooves 4 and 5. The inner end of the tier 7 is also semi-circular, as shown by the arc 12. The other edge is cut transversely in line with the edge of the tier 7. The right end edge of the breech block illustrated in FIGS. 3 and 4 is provided with a guide shoulder 13. The guide shoulder 13 has an oblique outer end which functions as a guide surface as the breech block or end-closure piece is pushed into the mortar adapter, i.e. into the grooves 4 and 5, by sliding against the inner surface of the barrel. This will be described in more detail further on. The breech block includes a striking pin mechanism 15, which is only shown schematically in the drawings and which is activated by the conventional mortar firing pin mechanism when the breech block is in a practice projectile firing position, i.e. a safety release position.

Figure 5:
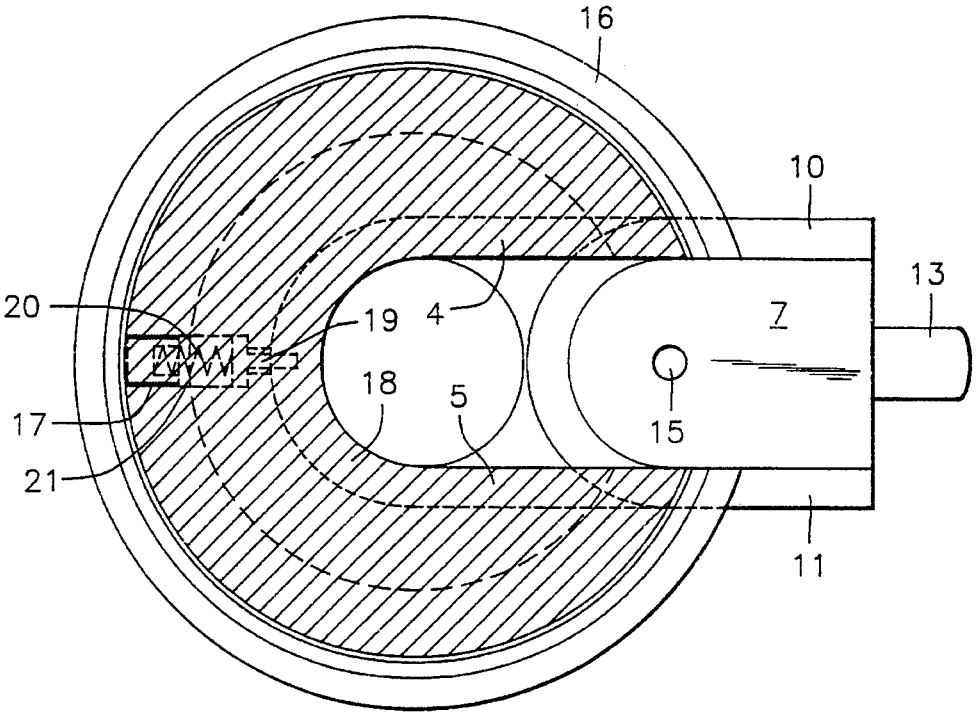
FIG. 5 is a cross-sectional view of the mortar adapter similar to the view shown in FIG. 2, with the end-closure piece partially inserted into the mortar adapter from one side thereof and located in a position of readiness in front of the launching tube.

FIG. 5 illustrates the breech block 7 inserted slightly into the mortar adapter, although the adapter has not yet been inserted fully into the mortar barrel, but lies in front of the mouth of the barrel. The barrel is referenced 16. FIG. 5 also illustrates a breech block counterpressure mechanism or anvil, generally referenced 17. The counterpressure mechanism is located in the mortar adapter on the same level as the grooves 4 and 5 and at the bottom thereof. As will be seen, the grooves 4 and 5 are terminated at their respective bottoms in a semi-circular shape 18 corresponding to the semi-circular shape 12 of the breech block. The counterpressure mechanism 17 is thus placed in the left end of the grooves 4 and 5. This counterpressure mechanism includes a pin 19 which acts against a pressure spring 20 and has an attachment in the bottom of a bore 21 accommodating the pin 19. The pin 19 is thus able to move backwards and forwards in the bore 21, against the force exerted by the spring 20.

FIG. 6 illustrates the next position of the breech block, where the practice projectile is made safe against firing. Thus, in this position, the practice projectile is located in the breech position, or alternatively a projectile propellant is placed in the breech position with the practice projectile placed in front of the propellant. Whichever case applies, the inner end of the propellant or the practice projectile, i.e. the end containing the fuse, rests against the upper side of the breech block 7. Since the practice projectile is centered in the breech, the detonator of the practice projectile will be located in the centre 22 of the breech. However, the breech block striking pin 15 is located on one side of the centre position 22, meaning that the detonator of the practice projectile cannot be activated, or alternatively the detonator of the propellant cannot be activated. For the sake of simplicity, the practice projectile will be considered to include a propellant in the following, and consequently no difference will now be made between a propellant and a practice projectile. As shown in FIG. 6, in this stage of operations, the breech block has not been inserted into the mortar adapter to an extent such that the guide shoulder passes free from the inner surface of the barrel 16. The mortar adapter thus still lies outside the mouth of the barrel. Neither is the inner end of the breech block affected by the counterpressure mechanism 17.

FIG. 7 illustrates the breech block 7 in a locked and firing position. In this stage, the breech block 7 has been inserted into the mortar adapter to an extent at which the guide shoulder 13 is in engagement with the inner surface of the barrel and in which the left end of the breech block presses the pin 19 against the force exerted by the spring 20. The mortar adapter is now inserted in the barrel and the pin 19 urges the breech block to the right through the action of the spring 20, so that the breech block 13 will now lie against the inner surface of the barrel. The breech block is therefore locked and located in its firing position, i.e. the firing pin 15 lies in the centre 22 of the barrel. When the mortar adapter, together with practice projectile and propellant, is dropped down in the barrel, the mortar firing mechanism will immediately activate the breech block firing pin and the propellant will be fired, so as to propel the practice projectile from the firing tube of the mortar adapter and thus from the mortar. The mortar adapter, on the other hand, remains in the mortar barrel. Immediately the mortar adapter is removed from the barrel, the breech block returns automatically to the position illustrated in FIG. 6, i.e. a safe position in which the mortar adapter can again be loaded with a propellant and practice projectile.

It should be noted that the mechanism described together with the breech block and grooves in the mortar adapter is referred to as a wedge mechanism in use with conventional guns. It should also be noticed that the mortar adapter has a configuration and weight which coincides with the shape and weight of standard conventional mortar ammunition.

It is emphasized that the mortar adapter (also called dummy mortar shell) is dropped into the mortar barrel and that the projectile propellant is fired when the mortar adapter reaches the firing position at the bottom of the mortar barrel, therewith propelling the practice projectile from the barrel.

I claim:

1. A mortar adaptor for insertion into a barrel of a firing pin-equipped mortar, said mortar adaptor comprising:

a substantially cylindrical adaptor body;

a central bore capable of accommodating a practice projectile of caliber smaller than that of the mortar;

a breech position defined in said central bore; and an automatic safety mechanism including:

a breech block which is slidably received in the substantially cylindrical adaptor body at said breech position, said breech block having an inside end disposed inside said substantially cylindrical adaptor body and an outside end located opposite to the inside end;

resilient means for urging said breech block outwardly of the substantially cylindrical adaptor body toward a safety position wherein said outside end of the breech block protrudes from a lateral side of said substantially cylindrical adaptor body, said breech block being slidable against said resilient means, into said substantially cylindrical adaptor body toward a firing position wherein said outside end is flush with said lateral side;

guide means located at said breech position and arranged transversely to a longitudinal axis of the substantially cylindrical adaptor body, for guiding said breech block slidably through the substantially cylindrical adaptor body; and an adaptor firing pin located in said breech block and arranged so that, when said breech block is in the firing position, said adaptor firing pin is aligned with the firing pin of the mortar to thereby facilitate firing of the practice projectile, and when said breech block is in the safety position, said breech block prevents firing by obstructing the firing pin of the mortar.

2. The mortar adaptor of claim 1, wherein the outside end of the breech block includes an oblique slide surface for engaging a distal end of the barrel and urging said breech block toward said firing position when said mortar adaptor is inserted into the barrel.

3. The mortar adaptor of claim 1, wherein said guide means includes substantially parallel grooves extending transversely to said central bore and extending from said lateral side around said central bore; and wherein said breech block comprises first and second tiers, said first tier having a first width corresponding to a diameter of said central bore thus defining a breech in said central bore at the breech position, said second tier having a second width greater than said first width to thereby define outer edges which are slidably received in said substantially parallel grooves.

4. The mortar adaptor of claim 1, wherein said inside end of the breech block has a semi-circular shape.

5. The mortar adaptor of claim 1, wherein said resilient means comprises a pin and a spring connected to the pin for urging the pin against said inside end of the breech block.

* * * * *